US006437745B1

(12) United States Patent
Väisänen et al.

(10) Patent No.: US 6,437,745 B1
(45) Date of Patent: Aug. 20, 2002

(54) EXPANSION CARD FOR WIRELESS DATA TRANSMISSION AND ANTENNA STRUCTURE FOR THE SAME

(75) Inventors: Ari Väisänen, Ruutana; Juha-Pekka Petterson, Kangasala, both of (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/691,539

(22) Filed: Oct. 18, 2000

(30) Foreign Application Priority Data

Oct. 20, 1999 (FI) ..... 19992267

(51) Int. Cl.[7] ..... H01Q 1/24
(52) U.S. Cl. ..... 343/702; 343/846
(58) Field of Search ..... 343/872, 702, 343/700 MS, 846; H01Q 1/24

(56) References Cited

U.S. PATENT DOCUMENTS

| | | | | |
|---|---|---|---|---|
| 4,123,756 A | | 10/1978 | Nagata et al. | 343/702 |
| 5,526,003 A | | 6/1996 | Ogawa et al. | 343/700 MS |
| 5,606,732 A | * | 2/1997 | Vignone | 343/702 |
| 5,764,190 A | | 6/1998 | Murch et al. | 343/702 |
| 5,828,346 A | * | 10/1998 | Park | 343/702 |
| 5,918,163 A | | 6/1999 | Rossi | 455/90 |
| 5,936,584 A | | 8/1999 | Lawrence et al. | 343/702 |
| 5,949,379 A | | 9/1999 | Yang | 343/702 |

FOREIGN PATENT DOCUMENTS

| | | |
|---|---|---|
| EP | 0623967 A1 | 11/1994 |
| EP | 0735609 A1 | 10/1996 |
| EP | 0867967 A2 | 9/1998 |
| EP | 0871236 A3 | 10/1998 |
| EP | 0932219 A2 | 7/1999 |
| WO | WO 97/49194 | 12/1997 |
| WO | WO 99/27607 | 6/1999 |

* cited by examiner

*Primary Examiner*—Michael C. Wimer
(74) *Attorney, Agent, or Firm*—Perman & Green, LLP

(57) ABSTRACT

The present invention relates to an expansion card and an antenna structure for this expansion card for wireless data transmission, which card (C) comprises a card part (1) to be placed inside an expansion card interface of an electronic device, and which antenna part for receiving and transmitting of signals comprises at least one electroconductive, radiating antenna plane (31) and a ground plane (32) arranged parallel to the same, at a distance, as well as a dielectric (33) between said planes. In the invention, for improving the antenna properties, said antenna structure is placed in a housing part (2) which is connected to the end of the card part (1) and which comprises a cover structure (21) and a bottom structure (22), for extending said antenna structure at least partly outside said interface, wherein the antenna plane (32) is arranged on the side of the cover structure (21), the ground plane (32) is arranged on the side of the bottom structure (22), and said dielectric is arranged a free clearance.

15 Claims, 2 Drawing Sheets

EXPANSION CARD FOR WIRELESS DATA TRANSMISSION AND ANTENNA STRUCTURE FOR THE SAME

Figure 1:
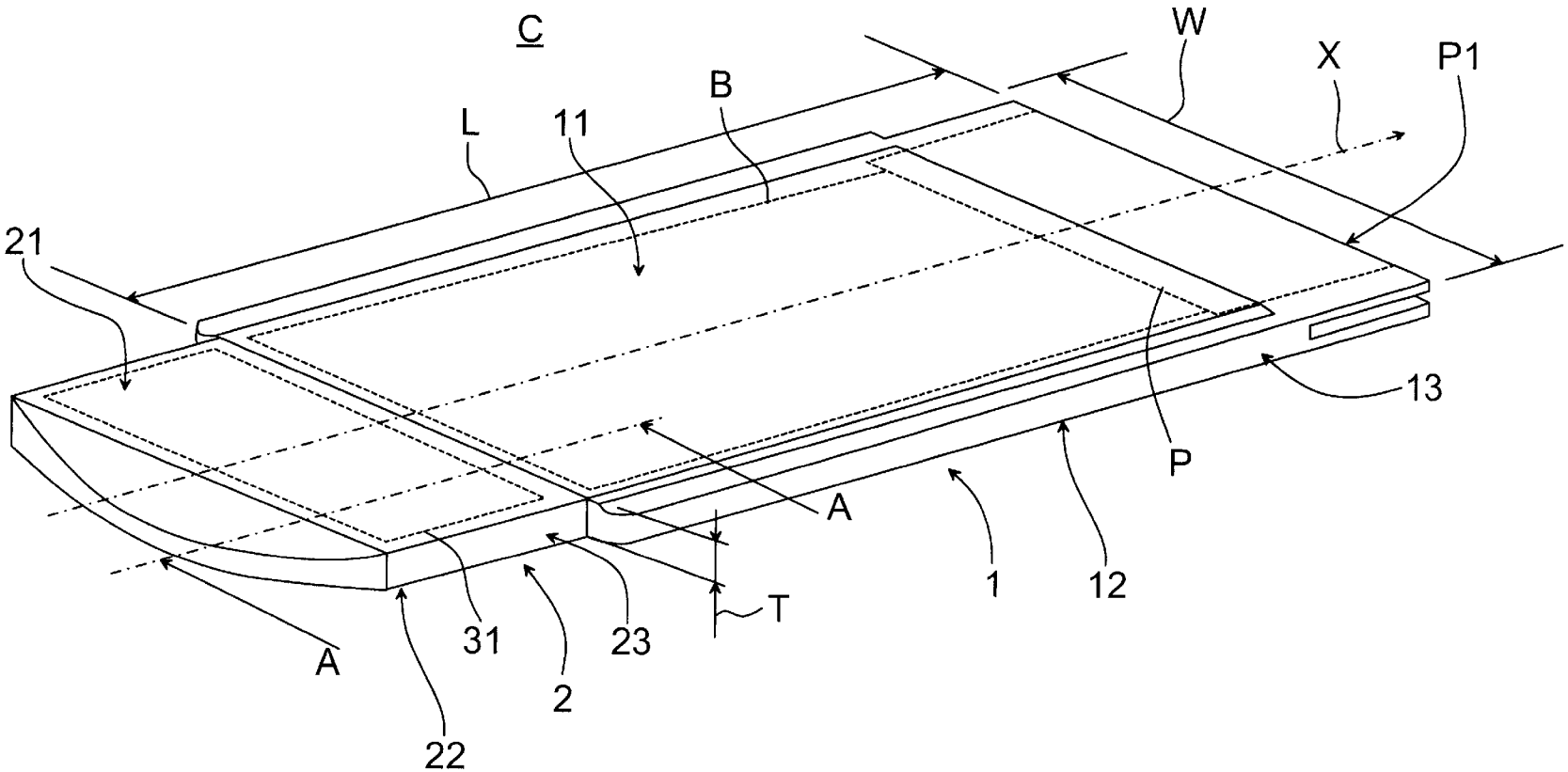

The present invention relates to an expansion card for wireless data transmission as set forth in the preamble of claim 1. The invention also relates to an antenna structure for an expansion card for wireless data transmission as set forth in the preamble of claim 10. Furthermore, the invention relates to a method for fitting an antenna structure in an expansion card for wireless data transmission as set forth in the preamble of claim 14.

According to prior art, various electronic devices, such as portable personal computers (PC) are often equipped with an expansion card interface, to which a standard expansion card can be connected. These expansion cards are intended to form a functional unit with the PC. The expansion card may contain the radio parts of a wireless communication device, including an antenna, wherein the PC can, by means of this card-like wireless communication device, communicate with a communication network, such as a mobile communication network (PLMN, Public Land Mobile Network), which can comply e.g. with the GSM standard (Global System for Mobile Communication). The expansion card can also form a network adaptor for a wireless local area network (WLAN), wherein the card comprises the necessary electrical circuits e.g. for signal processing and a transceiver. With the card, the PC can communicate with other PC devices or devices which form an access point of the local area network. Normally, these devices comprise a corresponding expansion card, used as a network adaptor, to which the wireless data transmission connection is formed. Said antennas are used for the transmission and reception of radio-frequency signals, and the signals are transferred e.g. between the radio part and the antenna of the wireless communication device normally by means of conductors and connectors.

One known expansion card is a PC card complying with the PCMCIA standard (Personal Computer Memory Card International Association). The PC cards are fitted to be placed fully inside the PC, but so-called extended PC cards are longer than conventional PC cards. These extended PC cards are placed partly outside the PC, wherein the thickness and design of the PC cards may vary in this part placed outside the PC. In a known manner, also the separate antenna of the wireless communication device is placed in this part.

Other known expansion cards include for example a so-called CompactFlash (CF) card complying with the CFA standard (Compact Flash Association). Other expansion cards also include a so-called Miniature Card, whose size is only 30 mm×33 mm×3.5 mm, as well as a so-called SmartMedia card, whose size is only 45 mm×37 mm×0.76 mm, and a so-called MultiMediaCard (MMC), whose size is only 32 mm×24 mm×1.4 mm.

One known card-like wireless communication device which comprises a transceiver with an antenna is Nokia Card Phone, i.e. a card phone which can be connected to expansion card interfaces of PC card types 11 and Ill. One WLAN card of prior art is presented in patent publication WO 97/49194, wherein the card part can be equipped with a housing part which contains a radiator functioning as an antenna and formed on a flexible printed circuit board (PCB), comprising a planar conical radiator and a ground potential fitted on the same plane. The radiator and the ground potential are formed by means of conductive copper layers. Another known antenna structure is an air-insulated PIFA antenna (Planar Inverted-F Antenna) which comprises a planar antenna plane having normally the shape of a parallelogram, and a ground plane fitted at a distance from and being normally parallel to the same. The planes used can be metal plates and metal coatings of a circuit board. One PIFA antenna structure is presented in patent publication EP 0 867 967 A2, in which an antenna plane made of a metal plate is supported in a wireless communication device above the ground plane. For the support, a special frame is used in which the antenna plane is fixed. One PIFA antenna structure placed in an expansion card is also known from patent publication EP 0 735 609 A1, in which the antenna plane is formed above a circuit board by coating it with a metal layer, and the ground plane is formed correspondingly on the lower surface of the circuit board. Said circuit board forms a dielectric located in an electric field formed between the planes, and the circuit board is further placed inside an expansion card.

When the card is placed fully inside an expansion card interface, the problem is, however, that the operating range of the antenna is considerably reduced or even totally hindered. This is due to the fact that the metal parts of the device surround the card on all sides, interfering in the reception and transmission of radio-frequency signals. Another problem is that the circuit board used as a dielectric increases antenna losses, and moreover, the distance between the planes can only be varied within the limits allowed by the circuit board. Particularly in expansion cards, the size of the circuit board is limited, wherein the antenna placed on the circuit board takes space from other components, such as integrated circuits (IC).

The electrical operation of the antenna is affected by the dielectric placed between the antenna plane and the ground plane. The electrical properties of this dielectric can be described with the dielectric constant $\in_r$ as well as with the loss tangent value. Losses are increased by all lossy structures which are placed in the electrical field between the antenna plane and the ground plane. Other factors affecting the operation of the PIFA antenna include dimensions of the antenna plane, the location of the feed point of the antenna plane and the earthing point, the disposition of the openings of the antenna plane, and the extent of the ground plane. In particular, when the frequency is increased, the losses of the circuit board material increase.

One known PIFA antenna structure is presented in patent publication EP 0 623 967 A1, wherein above a ground plane placed on the upper surface of a circuit board, and separated by an air gap, there is an antenna plane made of a metal plate which is supported to the circuit board by means of a shorting strip and a feeding strip. Furthermore, there are two antenna plates next to each other in different positions, wherein they form a so-called diversity antenna, wherein reflections and fadings of a radio signal can be taken into account in the reception. The dimension affecting the frequency band of the antenna, i.e. the frequency range within which the antenna is arranged to operate, is the distance between the antenna plane and the ground plane. As antenna structures according to the patent publications EP 0 623 967 A1 and EP 0 735 609 A1 are placed inside the expansion card, the problem is, however, that in the thin card e.g. the thickness of the structures must be limited, wherein also the distance between the antenna plane and the ground plane cannot become very large. The planes can be arranged on different sides of the circuit board, but then the circuit board causes power losses in the same way as the structures of lossy material between the planes.

It is an aim of the present invention to eliminate the above-mentioned drawbacks. The expansion card according to the invention is characterized in what will be presented in the characterizing part of claim 1. The antenna structure is characterized in what will be presented in the characterizing part of claim 10. The method is characterized in what will be presented in the characterizing part of claim 14.

It is an essential principle of the invention to place the antenna structure in a housing part, separately from the circuit board, wherein particularly the distance between the planes can be varied considerably more than in the limited space between the circuit board and the cover structures of the card. Furthermore, the whole inner part of the housing part can be utilized for the antenna structure, if necessary, wherein e.g. a diversity antenna can be located more freely, particularly further away, wherein the operating properties are thus improved. A particular advantage is that, thanks to its fixings, the space between the planes can be kept free from support structures, if necessary, wherein antenna losses can be minimized by arranging therebetween a free and unobstructed air gap with an optimal loss tangent value. A particular advantage is also that the distance between the planes can be maximized to increase the antenna efficiency and antenna gain can be maximized. The distance can thus be greater than the thickness of the circuit board used, or the distance between the circuit board and the cover structure. The invention can thus be used to considerably improve the properties of the antenna. In the invention, the antenna structure extends to different sides of the antenna but is simultaneously placed outside the circuit board.

Furthermore, the invention gives particular advantages, because the antenna structure is now placed separately from the circuit board, wherein the antenna structure can be arranged to be easily exchangeable without exchanging the circuit board. If also the necessary electrical contacts are arranged with spring means, it is particularly simple to exchange or to assemble the card. The whole housing part can be arranged to be exchangeable. A particular advantage is also obtained when the bottom structure of the card consists of a metal plate which can also be arranged as the ground plane. Said metal plate can be common to the card part and the housing part. The cover part of the housing part is preferably manufactured of a plastic material with little losses, wherein it does not interfere in the operation of the antenna plane. Electronic devices comprise processors and electrical circuits, and even weak interference signals radiated by them interfere in the operation of an antenna. By means of a housing part acting as a protrusion, the antenna structure can be arranged outside the interface and further away from the device, wherein the operating range of the antenna and the reliability of the card are improved. Because the antenna part is placed in the housing part, it is also possible to use a thin metal sheet in the manufacture of the card part without interfering the operation of the antenna.

The expansion card used as a wireless communication device according to the invention is particularly suitable for use in electronic devices which are suitable for low power radio frequency (LPRF) networks whose uses are wireless local area networks, such as piconets, wherein the operating range is normally 0.1–10 m, even 100 m if necessary. These wireless networks typically operated in the ISM range at a frequency of 2.4 GHz.

Figure 2:
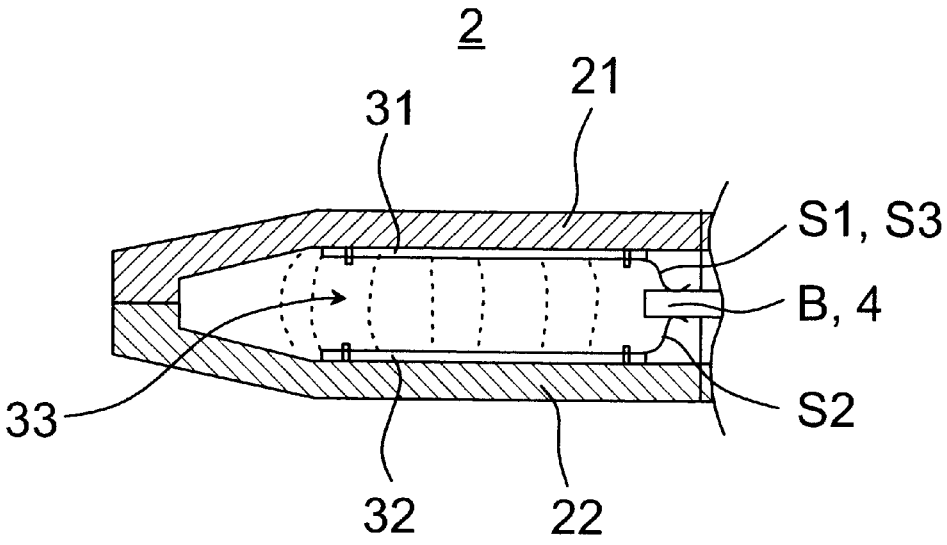
Figure 3:
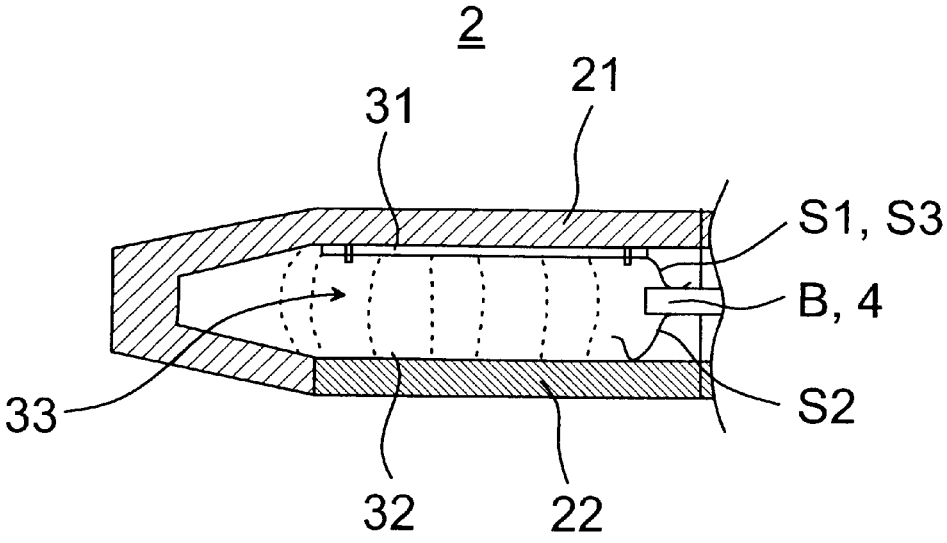

In the following, the invention will be described in more detail with reference to the appended drawings, in which FIG. 1 shows, in a perspective view, a preferred embodiment of an expansion card according to the invention, FIG. 2 shows a first embodiment of a cross-section at the point A—A of the expansion card according to FIG. 1, and FIG. 3 shows a second embodiment of a cross-section at the point A—A of the expansion card according to FIG. 1.

FIG. 1 shows an expansion card C according to an advantageous embodiment of the invention, where the card part 1 is a PC card complying with the PCMCIA standard. According to the PCMCIA standard, the length L of the PC card is 85.6 mm, and its width W is 54 mm. PC cards are divided into three types, wherein the thickness T of the PC card can be 3.3 mm (type I), 5.0 mm (type II) or 10.5 mm (type III). PC cards are arranged to be inserted fully inside the PC with a movement in the direction of the longitudinal axis X of the PC card, but so-called extended PC cards can be even 40 mm longer than ordinary PC cards. The PC card is equipped with a 68-pin connector P complying with the PCMCIA standard, by means of which the PC card is connected e.g. to a PC. The contact holes P1 of the connector P are arranged at the end of the PC card, on the outer surface outlining the PC card. According to a second advantageous embodiment of the invention, the expansion card is a CF card according to the CFA standard. The length L of the CF card is 42.8 mm, its width is 36.4 mm and thickness T is 3.3 mm (type I) or 5 mm (type II), and the card is equipped with a 50-pin connector P complying with the CFA standard.

With reference to FIG. 1, the connector P is normally fixed to a circuit board (not shown in the figure) which is placed inside the card C and which is also equipped with the components (for example an integrated circuit, IC) necessary for the functions of the PC card, and conductors for transferring electrical signals between the connectors and the components. The components (not shown in the figure) comprise a transceiver for processing of signals, which are transmitted and received at a radio frequency in a wireless manner by means of an antenna. The card C, usually a circuit board, is also equipped with the necessary conductors and electrical circuits for transfer of signals between the transceiver and the electronic device. Said circuits can also comprise components for processing of signals, and form e.g. a modem for transferring signals between the other circuits of the card C and the electronic device. The signals are transferred between the interface and the card C by means of said connector, by means of which the card C is coupled electrically and mechanically to the connector means of the interface, such as contact pins. The antenna is coupled to the transceiver normally also via an electrical matching circuit, by means of which the operation of the antenna can be tuned further. The operation of the transceiver, the operation of said electrical circuits, and the transmission of signals to the electronic device are known as such for anyone skilled in the art, wherein a more detailed description is not necessary. FIG. 1 illustrates the disposition of the connecter left partly inside the card C with a broken line P, the disposition of the circuit board left fully inside the card C with a broken line B, and the disposition of the antenna, particularly the antenna plane, left inside the housing part 2 of the card C with a broken line 31.

The card part 1 normally comprises a cover structure 11 and a bottom structure 12. The card part 1 can also comprise a frame structure 13 which at least partly forms an outer surface outlining the card C and to which the cover and bottom structures 11 and 12 are fixed. The cover and bottom structures are normally made of a thin metal sheet with a substantially even thickness. The connector P and the frame structure 13 are normally at least partly made of plastic, such as polyethylene (PE). It is obvious that the frame structure 13 can comprise several separate parts, and the connector P can simultaneously form a part of the frame structure 13, to which the bottom structure 12 is fixed. Thus, the cover structure can be made of e.g. plastic. The structure and dimensions of the card part 1 can vary even to a great extent within the scope of the invention.

The card C comprises a housing part 2 fixed at the end of the card part 1, where also the antenna structure is placed. The housing part 2 can also be arranged as a separate, exchangeable part, or as an integrated part with the card part 1. The housing part 2 is preferably placed outside the slot-like, nest-like expansion card interface. The housing part 2 comprises a cover structure 21 and a bottom structure 22, whose joint thickness preferably corresponds to the maximum thickness T of the card part 1 and whose joint width is preferably smaller than or equal to the width W of the card part. In the embodiment of FIG. 1, the width of the card part 2 corresponds to the width of the elevation made in the cover and bottom structures 11 and 12 of the card part 1, and the length of the housing part 2 is about one fifth of the total length of the card. Furthermore, the end of the housing part 2 is equipped with a rounded shape, but the shape and the dimensions can also be different from those presented here. It is obvious that the cover structure 21 and/or the bottom structure 22 can also be fixed to each other by means of a separate frame part which can also be integrated in the structure 21 or 22 and which forms the outer surface outlining the housing part 2. The cover part 21 of the housing part is preferably made of plastic, and according to a preferred embodiment of the card C, at least the cover structures 11 and 21 are seamlessly attached to each other. According to an advantageous embodiment of the invention, the bottom structure 22 is made of metal, wherein at least the bottom structures 12 and 22 are fixed to each other in a seamless way, forming an integrated piece.

With reference to FIG. 2, the antenna structure placed in the housing part 2 of the card C according to the invention is typically planar and a PIFA antenna (Planar Inverted-F Antenna) having the shape of a parallelogram, wherein in one advantageous embodiment, it forms a uniform antenna plate 31 which is, on one side, shorted out to the ground plane 32 by means of a contact means S3, preferably a spring contact, and a radio-frequency signal is fed from the transceiver to a suitable location in the antenna plate 31 for transmission. Correspondingly, in reception, a radio-frequency signal is fed from the antenna plate 31 via this location to the transceiver. The input takes place by means of a suitable contact means Si, preferably a spring contact. The shorting and the feed can also be arranged by means of wires and metal strips fixed to the antenna plate 31 in a stationary manner. By means of said metal strips, the antenna plate 31 can also be fixed and supported to said circuit board. In one embodiment of the invention, the ground plane 32 is coupled to the circuit board by means of a contact means S2, preferably a spring contact. The circuit board is provided with the necessary wirings e.g. by means of strip conductors, to which wirings the ground plane 32 and the antenna plane 31 are coupled e.g. on different sides of the circuit board to short the antenna plane 31. With reference to FIG. 2, the antenna plane 32 placed inside the housing part 2 is illustrated with broken lines for clarity, but it is obvious that the dimensions of the antenna plane can differ from those presented.

The antenna plane, which is normally rectangular, can comprise e.g. rectangular openings, holes, slots, and other shapes for example for tuning of operating frequencies.

With reference to FIGS. 2 and 3, the antenna structure of the invention comprises preferably a large ground plane 32 and at least one antenna plane 31 arranged at a selected distance from said ground plane 32 and acting as a radiator, which is made of an electroconductive material, preferably a metal sheet or a plate treated with a metal coating. The operation of the antenna also requires a dielectric 33 placed between the antenna plane 31 and the ground plane 32, which in the invention is preferably a free and unobstructed space filled by air, i.e. a clearance. Said clearance 33 is placed in the electrical field formed between the planes, wherein the properties of the clearance 33 affect the antenna. According to the invention, the antenna structure is placed in the housing part 2. To arrange the free clearance 33 between the planes 31 and 32, the antenna plane 31 is placed inside the housing part 2 in connection with the cover part 21, and said ground plane 32 is placed in connection with the bottom structure 22. Further with reference to FIGS. 2 and 3, according to an advantageous embodiment of the invention, the antenna plane 31 is fixed to the cover structure 21 which is preferably made of a dielectric material with small losses, such as plastic. The antenna plane 31 can be attached in different ways, for example by compressing, ultrasound welding, gluing, or snapping with spring locks. In one embodiment, the antenna plane 31 is fixed to the circuit board, from which it extends to contact with the housing part 2, the cover structure 21. The planes 31 and 32 are preferably parallel and planar, and they are placed on opposite sides inside the housing part 2. The planes are also substantially parallel with respect to the cover and bottom structures 11 and 12. The ground plane 32 is preferably placed to the side of the bottom structure 22 underneath the antenna plane 31, so that the radiation pattern of the antenna would, in the normal operating position of the card C, be directed upwards, e.g. towards a base station fixed to a wall. In the presented embodiment, all the cover and bottom structures 11, 12, 21 and 22 are substantially parallel and planar. The housing part 2 and the connector P are located on opposite ends of the card C.

With reference to FIG. 2, and in one embodiment of the invention, the ground plane 32 is fixed to the bottom structure 22. With reference to FIG. 3, in another embodiment of the invention, the bottom structure 22 simultaneously forms a large ground plane 31, wherein it is preferably made of a metal sheet. Thus, the advantage is that a separate ground plane does not need to be attached to the bottom structure 22. FIGS. 2 and 3 also present a coupling part 4, which can be the above-mentioned circuit board B, particularly when the antenna plane 31 is attached to the same. The part 4 can also be used as a connector means separate from the circuit board B, by means of which the input line, by means of the contact means S1, and the earthing line, by means of the contact means S3 (in the presented embodiment behind or in front of the means S1), are coupled to the antenna plane 31. The part 4 comprises the necessary conductors for coupling the lines further to the conductors of the circuit board B. The part 4 can be fixed for example to a frame structure 23, such as a partition wall, placed between the card part 1 and the housing part 2, and simultaneously form the required feed-through. The part 4 can be a connector or a separate circuit board. A connector is used particularly when the housing part 2 is arranged to be separate and exchangeable. In this case, the part 4 is fitted in a corresponding connector placed at the end of the card part 1 which is further connected to the circuit board B. Thus, for the card part 1, it is possible to arrange exchangeable housing parts 2 for coupling antennas with varying functional values and dimensions to the card part 1, or for replacing broken housing parts 2. To the part 4 is also connected, by means of a contact means S2, an earthing line of the ground plane 32, wherein when the part 4 is a connector, said line is also coupled to the antenna plane 31 and/or to the circuit board B. With reference to FIG. 3, when the bottom structure 22 also forms the ground plane 32, particularly when the bottom structures 22 and 12 together form the ground plane 32, the contact means S3 can also be placed in the card part 1, wherein the coupling can be made directly to the circuit board B.

In one embodiment of the invention, the housing part 2 is equipped with two antenna planes 31 next to each other, to utilize the above-mentioned diversity. Thus, each antenna plane 31 requires respective feeding and shorting lines and a connection to the circuit board B. The connection can be arranged e.g. by providing each antenna plane with separate connector means corresponding to the part 4. In the housing part 2, said antennas can be placed considerably more freely and spaciously when compared with prior art. In the invention, it is possible to place the antenna planes of a diversity antenna further away from each other, wherein also the functioning properties of the antenna are improved. The functions related to said diversity are prior art known to anyone skilled in the art, wherein their more detailed description will be rendered unnecessary.

The contact means S1, S2 and S3 are preferably metal strips or wires which operate in a spring-like manner and form a contact with electroconductive contact surfaces, such as strip conductors, formed on the circuit board B or the connector means 4. Alternatively, at least one contact means S1, S2 or S3 is fixed to the part 4 or to the circuit board B, wherein the contact surface is formed on the plane 31 or 32. By means of the spring-like means, the assembly of the card becomes simpler and faster when compared with integrated or soldered structured. According to the invention, the part 4, such as a circuit board B, does not extend through the clearance 33, wherein it would constitute a dielectric interfering the electrical field between the planes, and the antenna structure is at least primarily placed outside the circuit board B.

It is obvious that the invention is not limited solely to some advantageous embodiments of the inventions presented above, but it may vary within the scope of the claims.

We claim:

1. An expansion card for wireless data transmission, which card (C) comprises:

a card part (1) which is arranged to be placed at least partly inside an expansion card interface of an electronic device, a housing part (2) which is attached at the end of said card part (1) and is arranged to extend at least partly outside said interface, and which comprises a cover structure (21) and a bottom structure (22), and an antenna structure for receiving and transmitting signals, which structure comprises at least one electroconductive, radiating antenna plane (31) and a ground plane (32) arranged parallel to the same, at a distance, as well as a dielectric (33) between said planes, characterized in that for improving the antenna properties, said antenna structure is placed in the housing part (2), wherein said antenna plane (31) is arranged on the side of the cover structure (21), the ground plane (32) is arranged on the side of the bottom structure (22), and as said dielectric is arranged a free clearance.

2. The expansion card according to claim 1, characterized in that the antenna plane (31) is attached to the cover structure (21).

3. The expansion card according to claim 1, characterized in that the antenna plane (31) is arranged to be coupled electrically to a circuit board (B) placed inside the card (C) by means of at least one spring-like contact means (S1, S3).

4. The expansion card according to claim 1, characterized in that the antenna plane (31) is attached to a circuit board (B) which is placed inside the card (C) and from which said antenna plane (31) extends to the housing part (2).

5. The expansion card according to claim 1, characterized in that the ground plane (32) is fixed to the bottom structure (22).

6. The expansion card according to claim 1, characterized in that the ground plane (31) arranged is the bottom structure (22) which is made of an electroconductive material.

7. The expansion card according to claim 1, characterized in that the ground plane (31) is arranged to be coupled electrically to a circuit board (B) placed inside the card (C) by means of at least one spring-like contact means (S2).

8. The expansion card according to claim 1, characterized, in that the card (C) is equipped with a transceiver, coupled electrically to the antenna structure, for processing of signals, and an electric circuit connected therewith for transferring signals between said electronic device and the card (C), wherein the opposite end of said card part (C) is further equipped with connector means (P) for coupling said card (C) electrically to said expansion card interface.

9. The expansion card according to claim 1, characterized in that at least the card part (1) is formed to comply with the PCMCIA standard.

10. The expansion card according to claim 1, characterized in that the card comprises a circuit board, in which the antenna plane and ground plane are coupled electrically, and that the antenna structure extends to different sides of the circuit board in a manner that the antenna structure is at the same time mainly placed outside the circuit board, wherein the antenna plane and the ground plane are both connected to the circuit board by means of at least one spring-like contact means to facilitate the exchange or assembly of the antenna structure from or with the circuit board.

11. An antenna structure for an expansion card for wireless data transmission, which card (C) comprises a card part (1) to be placed inside an expansion card interface of an electronic device, and which antenna structure for receiving and transmitting of signals comprises at least one electroconductive, radiating antenna plane (31) and a ground plane (32) arranged parallel to the same, at a distance, as well as a dielectric (33) between said planes, characterized in that for improving the antenna properties, said antenna structure is arranged in a housing part (2) which is to be placed at the end of the card part (1) and which comprises a cover structure (21) and a bottom structure (22), for extending said antenna structure at least partly outside said interface, wherein the antenna plane (32) is arranged on the side of the cover structure (21), the ground plane (32) is arranged on the side of the bottom structure (22), and said dielectric is arranged a free clearance.

12. The antenna structure according to claim 11, characterized in that said ground plane (31) arranged is the bottom structure (22) of said housing part (2), made of an electroconductive material.

13. The antenna structure according to claim 11, characterized in that it is arranged in said housing part (2) which is arranged to be attached to said card part (1) in a detachable manner.

14. The antenna structure according to claim 11, characterized in that said housing part (2) is equipped with connector means (4) for coupling the antenna structure electrically to said card part (1).

15. A method for arranging an antenna structure in an expansion card for wireless data transmission, which card (C) comprises a card part (1) to be placed inside an expansion card interface of an electronic device, and which antenna structure for receiving and transmitting of signals comprises at least one electroconductive, radiating antenna plane (31) and a ground plane (32) arranged parallel to the same, at a distance, as well as a dielectric (33) between said planes, characterized in that for improving the antenna properties, said antenna structure is arranged in a housing part (2) which is connected to the end of the card part (1) and which comprises a cover structure (21) and a bottom structure (22), for extending said antenna structure at least partly outside said interface, wherein the antenna plane (32) is arranged on the side of the cover structure (21), the ground plane (32) is arranged on the side of the bottom structure (22), and said dielectric is arranged a free clearance.

* * * * *